US011420197B2

(12) United States Patent
Moskalev et al.

(10) Patent No.: US 11,420,197 B2
(45) Date of Patent: Aug. 23, 2022

(54) APPARATUS AND METHOD FOR MIXING FLUID OR MEDIA BY VIBRATING A PIPETTE USING NONCONCENTRIC MASSES

(71) Applicant: Hycor Biomedical, LLC, Indianapolis, IN (US)

(72) Inventors: Anatoly Moskalev, Irvine, CA (US); Steven M. Gann, Huntington Beach, CA (US); Anthony Dezan, Irvine, CA (US); Yinglei Tao, Foothill Ranch, CA (US); Jonathan Miao, Newport Beach, CA (US); Taylor Reid, Carlsbad, CA (US); Evan McMenamy, Mission Viejo, CA (US)

(73) Assignee: Hycor Biomedical, LLC, Indianapolis, IN (US)

( * ) Notice: Subject to any disclaimer, the term of this patent is extended or adjusted under 35 U.S.C. 154(b) by 400 days.

(21) Appl. No.: 16/180,639

(22) Filed: Nov. 5, 2018

(65) Prior Publication Data

US 2020/0139318 A1 May 7, 2020

(51) Int. Cl.
*B01L 3/02* (2006.01)
*B01L 3/00* (2006.01)

(52) U.S. Cl.
CPC ..... *B01L 3/021* (2013.01); *B01L 3/502* (2013.01); *B01L 3/5082* (2013.01); *B01L 2400/043* (2013.01)

(58) Field of Classification Search
CPC ..... B01L 3/021; B01L 3/502; B01L 3/5082; B01L 2400/043
See application file for complete search history.

(56) References Cited

U.S. PATENT DOCUMENTS

2014/0099240 A1* 4/2014 Misono ..... B01L 3/0217 422/514
2015/0198621 A1* 7/2015 Ootani ..... G01N 35/0098 422/64
2018/0246134 A1* 8/2018 LaChance ..... B01L 3/527

* cited by examiner

*Primary Examiner* — Jennifer Wecker
*Assistant Examiner* — Oyeleye Alexander Alabi
(74) *Attorney, Agent, or Firm* — K&L Gates LLP

(57) ABSTRACT

Methods and apparatuses for mixing a fluid/media for an assay are disclosed herein. In an embodiment, a mixing device for an immunochemistry system includes a pipette configured to aspirate fluid and/or paramagnetic particles from or dispense fluid and/or paramagnetic particles into a cuvette, at least one nonconcentric mass configured cause the pipette to move in a mixing motion, and a control unit configured to activate the at least one nonconcentric mass while the pipette is located within the cuvette so as to mix the fluid and/or paramagnetic particles within the cuvette.

19 Claims, 11 Drawing Sheets

APPARATUS AND METHOD FOR MIXING FLUID OR MEDIA BY VIBRATING A PIPETTE USING NONCONCENTRIC MASSES

FIELD OF THE DISCLOSURE

The present disclosure relates generally to methods and apparatuses for mixing fluid/media for an assay, and more specifically to a system that utilizes unbalanced, nonconcentric masses to cause a pipette or other stirrer to mix fluid/media and break up clusters of paramagnetic particles within a cuvette.

BACKGROUND OF THE DISCLOSURE

Some immunochemistry analysis systems require that analyte molecules in a patient's biological sample (e.g. serum or plasma) attach to paramagnetic particles. Such systems require that magnets be positioned so that the paramagnetic particles can be localized and one or more washing steps can be performed to remove background signals associated with potential contaminants and interfering substances that may be present in samples. When a magnetic force is applied to the paramagnetic particles, however, the magnetic force can cause the paramagnetic particles to cluster, even after the magnetic force is removed. There is accordingly a need for equipment that can mix the paramagnetic particles to break up the clusters so that assays can be performed using the paramagnetic particles.

SUMMARY OF THE DISCLOSURE

The present disclosure is directed to a mixing device configured to mix/fluid media and/or break up clusters of paramagnetic particles within a cuvette. In an example embodiment, which may be used in combination with any other embodiment described herein, a mixing device for an immunochemistry system includes a pipette configured to aspirate fluid and/or paramagnetic particles from or dispense fluid and/or paramagnetic particles into a cuvette, at least one nonconcentric mass configured cause the pipette to move in a mixing motion, and a control unit configured to activate the at least one nonconcentric mass while the pipette is located within the cuvette so as to mix the fluid and/or paramagnetic particles within the cuvette.

In another embodiment, which may be used in combination with any other embodiment described herein, the at least one nonconcentric mass includes a first nonconcentric mass configured cause the pipette to move in a first circular pattern and a second nonconcentric mass configured to cause the pipette to move in a second circular pattern, the second circular pattern having a smaller radius than the first circular pattern, and wherein the control unit is configured to activate the first and second nonconcentric masses to cause the pipette to move in the first circular pattern and the second circular pattern simultaneously.

In another embodiment, which may be used in combination with any other embodiment described herein, rotation of one of the first and second nonconcentric masses causes rotation of the other of the first and second second nonconcentric masses.

In another embodiment, which may be used in combination with any other embodiment described herein, rotation of one of the first and second nonconcentric masses rotates at least one intermediate gear to cause rotation of the other of the first and second nonconcentric masses.

In another embodiment, which may be used in combination with any other embodiment described herein, the first and second nonconcentric masses rotate in opposite directions.

In another embodiment, which may be used in combination with any other embodiment described herein, the first and second nonconcentric masses rotate about the same axis.

In another embodiment, which may be used in combination with any other embodiment described herein, both of the first and second nonconcentric masses are physically nonconcentric, creating an imbalanced mass when rotated.

In another embodiment, which may be used in combination with any other embodiment described herein, the at least one nonconcentric mass includes an indentation on an outer perimeter thereof.

In another embodiment, which may be used in combination with any other embodiment described herein, the at least one nonconcentric mass includes a solid portion and an open portion.

In another embodiment, which may be used in combination with any other embodiment described herein, the at least one nonconcentric mass is weighted nonconcentrically, creating an imbalanced mass when rotated.

In another embodiment, which may be used in combination with any other embodiment described herein, wherein the at least one nonconcentric mass is physically nonconcentric, creating an imbalanced mass when rotated.

In another embodiment, which may be used in combination with any other embodiment described herein, the mixing device includes a dislodgement detection subassembly configured to determine if the pipette has become dislodged.

In another embodiment, which may be used in combination with any other embodiment described herein, the dislodgement detection subassembly includes at least one rod extending from a pipetting assembly including the pipette to a mixing assembly including the first and second nonconcentric masses.

In another embodiment, which may be used in combination with any other embodiment described herein, the control unit activates the first and second nonconcentric masses by controlling a motor to rotate the first and second nonconcentric masses.

In another embodiment, which may be used in combination with any other embodiment described herein, rotation of one of the first and second nonconcentric masses by the motor causes rotation of the other of the first and second nonconcentric masses.

In another embodiment, which may be used in combination with any other embodiment described herein, the pipette is removably attachable to the mixing device.

In another embodiment, which may be used in combination with any other embodiment described herein, the control unit is configured to activate the at least one nonconcentric mass while the pipette is located within the cuvette to cause the pipette to move in a spirograph pattern.

In another embodiment, which may be used in combination with any other embodiment described herein, the control unit is configured to activate the at least one nonconcentric mass while the pipette is located within the cuvette to cause the pipette to move in a roulette curve pattern.

In another embodiment, which may be used in combination with any other embodiment described herein, a mixing device for an immunochemistry system includes a stirrer configured to translate into a cuvette, a first nonconcentric mass configured to cause the stirrer to move in a first circular pattern, a second nonconcentric mass configured to cause the stirrer to move in a second circular pattern, the second circular pattern having a smaller radius than the first circular pattern, and a control unit configured to activate the first and second nonconcentric masses to cause the stirrer to move within the cuvette in the first circular pattern and the second circular pattern simultaneously.

In another embodiment, which may be used in combination with any other embodiment described herein, the stirrer includes a pipette.

In another embodiment, which may be used in combination with any other embodiment described herein, the control unit is configured to activate the first and second nonconcentric masses to cause the stirrer to move in a spirograph pattern.

In another embodiment, which may be used in combination with any other embodiment described herein, the control unit is configured to activate the first and second nonconcentric masses to cause the stirrer to move in a roulette curve pattern.

In another embodiment, which may be used in combination with any other embodiment described herein, a method of mixing paramagnetic particles within a cuvette includes injecting paramagnetic particles from a pipette into a cuvette, applying a magnetic force outside of the cuvette to attract the paramagnetic particles to a wall of the cuvette, and moving the pipette within the cuvette in a first circular pattern and a second circular pattern simultaneously, the second circular pattern having a smaller radius than the first circular pattern.

In another embodiment, which may be used in combination with any other embodiment described herein, moving the pipette includes rotating first and second nonconcentric masses, the first nonconcentric mass causing the pipette to move in the first circular pattern, the second nonconcentric mass causing the pipette to move in the second circular pattern.

In another embodiment, which may be used in combination with any other embodiment described herein, the method includes removing the magnetic force prior to moving the pipette within the cuvette in the first and second circular patterns simultaneously.

In another embodiment, which may be used in combination with any other embodiment described herein, moving the pipette within the cuvette in the first and second patterns simultaneously causes the stirrer to move in a roulette curve pattern.

In another embodiment, which may be used in combination with any other embodiment described herein, moving the pipette within the cuvette in the first and second patterns simultaneously causes the stirrer to move in a spirograph pattern.

In another embodiment, which may be used in combination with any other embodiment described herein, moving the pipette within the cuvette includes moving the pipette in the first circular pattern opposite to the second circular pattern.

In another embodiment, which may be used in combination with any other embodiment described herein, a mixing device for an immunochemistry system includes a pipette configured to aspirate fluid from or dispense fluid into a cuvette, a first nonconcentric mass configured cause the pipette to move in a first circular pattern, a second nonconcentric mass configured to cause the pipette to move in a second circular pattern, the second circular pattern having a smaller radius than the first circular pattern, and a control unit configured to activate the first and second nonconcentric masses to cause the pipette to move in the first circular pattern and the second circular pattern simultaneously.

In another embodiment, which may be used in combination with any other embodiment described herein, a mixing device for an immunochemistry system includes a pipette configured to aspirate fluid from or dispense fluid into a cuvette, a mixing assembly configured to cause displacement of the pipette, and a control unit configured to control the mixing assembly to cause the pipette to move according to a roulette curve pattern within the cuvette to mix fluid within the cuvette or break up clusters of paramagnetic particles within the cuvette.

In another embodiment, which may be used in combination with any other embodiment described herein, the mixing assembly includes a first nonconcentric mass configured cause the pipette to move in a first circular pattern, and a second nonconcentric mass configured to cause the pipette to move in a second circular pattern, the second circular pattern having a smaller radius than the first circular pattern, and movement of the pipette in the first circular pattern and the second circular pattern simultaneously causing the roulette curve pattern.

In another embodiment, which may be used in combination with any other embodiment described herein, the mixing assembly includes a motor, and the control unit controls the motor to cause rotation of the first and second nonconcentric masses.

In another embodiment, which may be used in combination with any other embodiment described herein, an immunochemistry analysing system includes a source of paramagnetic particles, a source of fluid, at least one cuvette configured to receive the paramagnetic particles from the source of paramagnetic particles and the fluid from the source of fluid, at least one pipette configured to (i) translate so that at least a portion of the at least one pipette is located within the at least one cuvette and (ii) dispense at least one of the paramagnetic particles from the source of paramagnetic particles and the fluid from the source of fluid into the at least one cuvette so that the paramagnetic particles and/or the fluid can be mixed within the cuvette, a mixing assembly configured to displace the at least one pipette while at least a portion of the at least one pipette is located in the at least one cuvette, and a control unit configured to control the mixing assembly to cause the pipette to be displaced according to a roulette curve pattern within the cuvette to mix fluid within the cuvette or break up clusters of paramagnetic particles within the cuvette.

In another embodiment, which may be used in combination with any other embodiment described herein, an immunochemistry analysing system includes a source of paramagnetic particles, a source of fluid, at least one cuvette configured to receive the paramagnetic particles from the source of paramagnetic particles and the fluid from the source of fluid, at least one pipette configured to (i) translate so that at least a portion of the at least one pipette is located within the at least one cuvette and (ii) dispense at least one of the paramagnetic particles from the source of paramagnetic particles and the fluid from the source of fluid into the at least one cuvette so that the paramagnetic particles and/or the fluid can be mixed within the cuvette, a mixing assembly configured to displace the at least one pipette while at least a portion of the at least one pipette is located in the at least one cuvette, and a control unit configured to control the mixing assembly to cause the pipette to be displaced in a first circular pattern and a second circular pattern simultaneously, the second circular pattern having a smaller radius than the first circular pattern.

In another embodiment, which may be used in combination with any other embodiment described herein, a method of mixing paramagnetic particles within a cuvette includes injecting paramagnetic particles from a pipette into a cuvette, applying a magnetic force outside of the cuvette to attract the paramagnetic particles to a wall of the cuvette, rotating a first nonconcentric mass to cause the pipette to move in a first circular pattern within the cuvette, and rotating a second nonconcentric mass to cause the pipette to move in a second circular pattern within the cuvette, the second circular pattern having a smaller radius than the first circular pattern.

In another embodiment, which may be used in combination with any other embodiment described herein, the method includes rotating the first nonconcentric mass and the second nonconcentric mass simultaneously to cause the pipette to move in a roulette curve pattern within the cuvette.

In another embodiment, which may be used in combination with any other embodiment described herein, a mixing device for an immunochemistry system includes a stirrer configured to stir paramagnetic particles within the cuvette, and a control unit configured to move the stirrer in a roulette pattern within the cuvette.

In an embodiment, the center of mass of the whole moving assembly including the pipette is located in the same horizontal plane in which external forces of needle translation in horizontal direction are applied, minimizing parasitic pipette tip vibrations due to accelerations of horizontal pipette translation.

In an embodiment, a common center of gravity of an assembly including the pipette is located in the same plane with an external force which accelerates mixing in a lateral direction, eliminating parasitic pipette vibrations due to required relocation of the mixing device between different places in the overall instrument.

BRIEF DESCRIPTION OF THE DRAWINGS

Embodiments of the present disclosure will now be explained in further detail by way of example only with reference to the accompanying figures, in which.

DETAILED DESCRIPTION

Before describing in detail the illustrative system and method of the present disclosure, it should be understood and appreciated herein that the present disclosure relates to methods and apparatuses that perform diagnostic assays for different types of analyte molecules of interest, specifically for molecules that bind to immunogens. In general, the system utilizes common paramagnetic particles, for example magnetic beads or microparticles, that are pulled to the wall of a reaction cuvette by magnets during a washing process so that liquid can be aspirated from the cuvette. Disclosed herein is an advantageous system and method for mixing the paramagnetic particles. It is also contemplated that the present disclosure can also be applied to fluid dispensing and/or mixing systems that do not utilize paramagnetic particles.

As explained in more detail below, using the illustrative system and method of the present disclosure, paramagnetic particles can be coated with one or more capture reagent that will eventually bind analyte molecules of interest in a patient's blood sample. In example embodiments, the capture molecule is an immunogen which binds an immunogen-binding molecule (analyte), such as an antibody, in the patients' blood sample. After the capture reagents bind to the paramagnetic particles and the cuvettes undergo a washing process, a patient sample, and optionally a diluent if needed, can be added to the particles in the reaction cuvette and incubated. This allows analytes of interest in the patient's blood sample to bind to one or more capture reagent that has in turn been bound to the surface of a paramagnetic particle. After a patient sample incubation period, another washing process can be performed to remove any excess or unbound sample, and then a conjugate and a luminescent label can be added to the cuvette. When added to the cuvette, it can be expected that some portion of the conjugate will bind to the capture reagent/sample complex on the paramagnetic particles after an incubation period. The particles then undergo another wash process to remove any unbound conjugate, and then a luminescent label is added to the reaction cuvette and incubated for a short period of time to allow the chemiluminescent glow reaction to reach equilibrium. After equilibrium is reached, luminescence and fluorescence readings of the sample can be taken to perform an assay.

Figure 1:
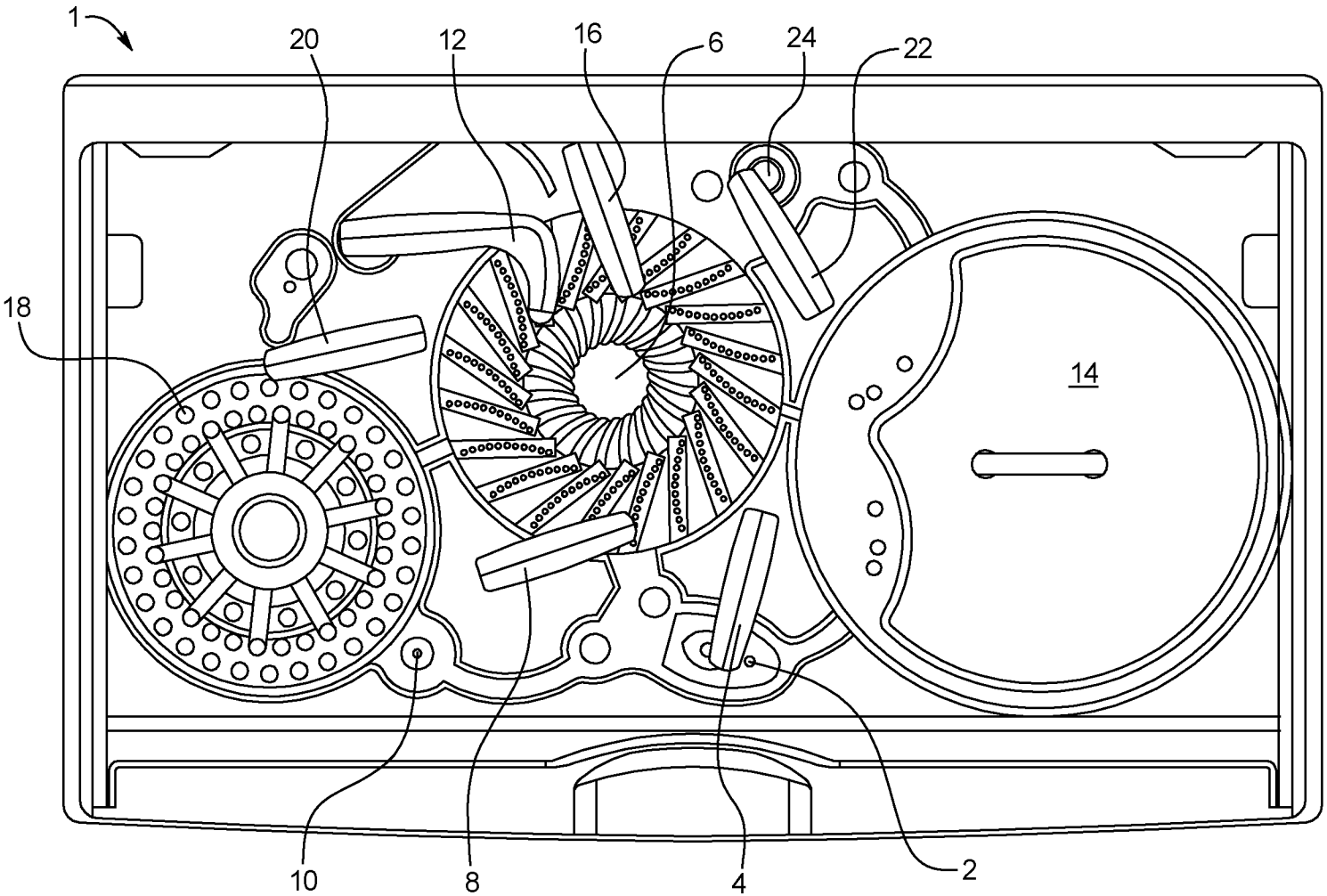
FIG. 1 is a top plan view of an example embodiment of an automated immunochemistry analyzer and reagent system according to the present disclosure.

FIG. 1 illustrates various components of an example embodiment of an automated immunochemistry system 1 according to the present disclosure. Automated immunochemistry system 1 can take an analyte sample, create an environment that will allow it to bind to a paramagnetic particle, perform a number of washing steps, and then quantify and normalize the luminescence signal of the analyte sample. This can be accomplished through an automated process that utilizes a vortexer 2, an R1 pipettor 4, a reaction rotor 6, an optics pipettor 8, an optics device 10, a multi rinse pipettor 12, a reagent rotor 14, a single rinse pipettor 16, a sample rotor 18, a sample pipettor 20, an R2 pipettor 22, and a mixed substrate container 24.

In one embodiment disclosed herein, an apparatus such as automated immunochemistry system 1 can quantify and normalize the luminescence signal of an analyte sample before reaction of the analyte with the capture reagent. In an embodiment, automated immunochemistry system 1 begins by first dispensing one or more capture reagent and/or fluorescently labelled paramagnetic particles, or fluo-beads, into a cuvette 50 located within the reaction rotor 6. The fluo-beads can be initially located in vortexer 2 and transferred to reaction rotor 6 by R1 pipettor 4. R1 pipettor 4 can aspirate a desired quantity of the fluo-bead mixture and transfer the aspirated quantity to reaction rotor 6 where it is injected into a cuvette 50 of reaction rotor 6. Optics pipettor 8 can then aspirate a test sample from the cuvette 50 of reaction rotor 6 and transfer the test sample to optics device 10, where fluorescence and luminescence measurements can be recorded. The initial recording of the fluorescence and luminescence signal can be used as a baseline measurement for the initial concentration of fluo-beads in a sample. After recording the measurements, multi rinse pipettor 12 can rinse the cuvettes 50 using a wash buffer.

In order to prepare the analytical substrates, R1 pipettor 4 can aspirate one or more capture reagent from reagent rotor 14 and inject the one or more capture reagent into a cuvette 50 in reaction rotor 6. R1 pipettor 4 can also transfer fluo-beads from vortexer 2 to the cuvette 50 in reaction rotor 6. After an incubation period, single rinse pipettor 16 can inject a rinse buffer to stop the capture reagent binding reaction with precise timing. A substantial amount of the suspended fluo-beads can then be localized by magnets within the reaction rotor 6 over a period of time. After the magnets have substantially localized the fluo-beads within the cuvette 50, multi rinse pipettor 12 can aspirate and dispose of a portion of the rinse buffer, leaving a portion of the fluo-beads localized within the cuvette 50. Multi rinse pipettor 12 can proceed to inject a wash buffer into the cuvette 50 of reaction rotor 6, resuspending the fluo-beads. The fluo-beads can again be localized by the magnets within reaction rotor 6 to be followed by multi rinse pipettor 12 aspirating and discarding a portion of the sample that was not localized from the cuvette 50 in the reaction rotor 6. Thus, any unbound capture reagent is removed from the cuvette 50.

A patient sample can be contained in a sample tube in sample rotor 18. The patient sample can further be partially diluted with a sample diluent. At this point, sample pipettor 20 can aspirate a portion of the patient sample and inject the patient sample into the cuvette 50 of reaction rotor 6 using the mixing mechanism described herein to resuspend the fluo-beads. The cuvette 50 containing the patient sample within the reaction rotor 6 can then incubate the patient sample. In one embodiment, for example, the incubation temperature can be about 37° C.+/−about 0.2° C., while the incubation time can be about 37.75 minutes+/−about 2 minutes. After incubation, multi rinse pipettor 12 can inject the rinse buffer to again resuspend the fluo-beads. Another localization process is performed by reaction rotor 6 by allowing the fluo-beads to substantially collect within the cuvette 50 near the magnets in reaction rotor 6. After the localization of the fluo-beads, multi rinse pipettor 12 can aspirate and discard a portion of the fluid within the cuvette 50 of reaction rotor 6 that was not localized during the localization process.

Multiple rinse cycles can then be performed on the sample within the cuvette 50 of reaction rotor 6. The rinse cycles can be performed using multi rinse pipettor 12 to inject a wash buffer into the cuvette 50 to resuspend the fluo-beads. Another localization step can allow the fluo-beads to collect within the cuvette 50 by the magnets within reaction rotor 6. After about a 90 second fluo-beads collection period, multi rinse pipettor 12 can aspirate and discard a portion of the wash buffer, leaving a substantial portion of the fluo-beads within the cuvette 50 of the reaction rotor 6. Another rinse cycle can then occur using multi rinse pipettor 12 to again inject wash buffer into the cuvette 50 and allow the fluo-beads to resuspend. Another fluo-bead localization process can utilize the magnets within the reaction rotor 6 to localize the fluo-beads from the rest of the sample. Finally, the multi rinse pipettor 12 can aspirate a portion of the sample that was not localized by the localization process.

At this point, R1 pipettor 4 can aspirate a conjugate contained in a conjugate cuvette within reagent rotor 14. R1 pipettor 4 can then inject the previously aspirated conjugate into the cuvette 50 of the reaction rotor 6 using the mixing mechanism described herein to resuspend the beads. After incubating the cuvette 50 under controlled time and temperature in reaction rotor 6, multi rinse pipettor 12 can inject a rinse buffer into the cuvette 50 in reaction rotor 6. Another fluo-bead localization cycle can be performed by allowing magnets within reaction rotor 6 to substantially localize the fluo-beads within the cuvette 50. Multi rinse pipettor 12 can aspirate and discard a portion of the sample within the cuvette 50 that has not been localized during the localization cycle.

Multiple rinse cycles can be performed on the sample within the cuvette 50 of reaction rotor 6. Multi rinse pipettor 12 can inject a wash buffer to resuspend the fluo-beads within the cuvette 50. Another fluo-bead localization cycle can localize the fluo-beads by locating the cuvette 50 within close proximity to the magnets in reaction rotor 6 over an adequate period of time. After the localization cycle, multi rinse pipettor 12 can aspirate and discard a portion of the sample that was not localized during the localization cycle. Another wash cycle can then occur by using multi rinse pipettor 12 to inject the wash buffer to resuspend the fluo-beads. Another localization cycle can utilize the magnets within reaction rotor 6 to localize the fluo-beads within the cuvette 50. After the localization process, multi rinse pipettor 12 can again aspirate and discard a portion of the sample that was not localized during the localization cycle.

R2 pipettor 22 can then aspirate a substrate or a mixed substrate sample from the mixed substrate container 24 and inject the substrate or mixed substrate sample into the cuvette 50 of the reaction rotor 6 using the mixing mechanism described herein to resuspend the beads, resuspending the fluo-bead with the mixed substrate sample. The sample is then incubated for a period of time. The sample in the cuvette 50 of reaction rotor 6 can then be aspirated by optics pipettor 8 and placed in optics device 10. After optics device 10 makes fluorescence and luminescence optical observations, the sample is discarded and the multi rinse pipettor rinses the cuvettes 50 of reaction rotor 6 in preparation for the next test.

One issue that can arise when using paramagnetic particles, or fluo-beads, in a device such as the automated immunochemistry analysis system 1 shown in FIG. 1 is that the paramagnetic particles can cluster at the sides of the cuvette 50 after the magnetic force is applied to and removed from the cuvette 50. To break up the paramagnetic particles, R1 pipettor 4, sample pipettor 20 and R2 pipettor 22 illustrated in the embodiment of FIG. 1 can be configured as a fluid dispensing and mixing device 100 according to the present disclosure that mixes the paramagnetic particles within one or more cuvette 50 within reaction rotor 6. FIGS. 2 to 11 illustrate example embodiments of such a fluid dispensing and mixing device 100 according to the present disclosure. It should be understood that every element in device 100 could also be shown in FIG. 1 but has been omitted from FIG. 1 for simplicity.

Figure 2:
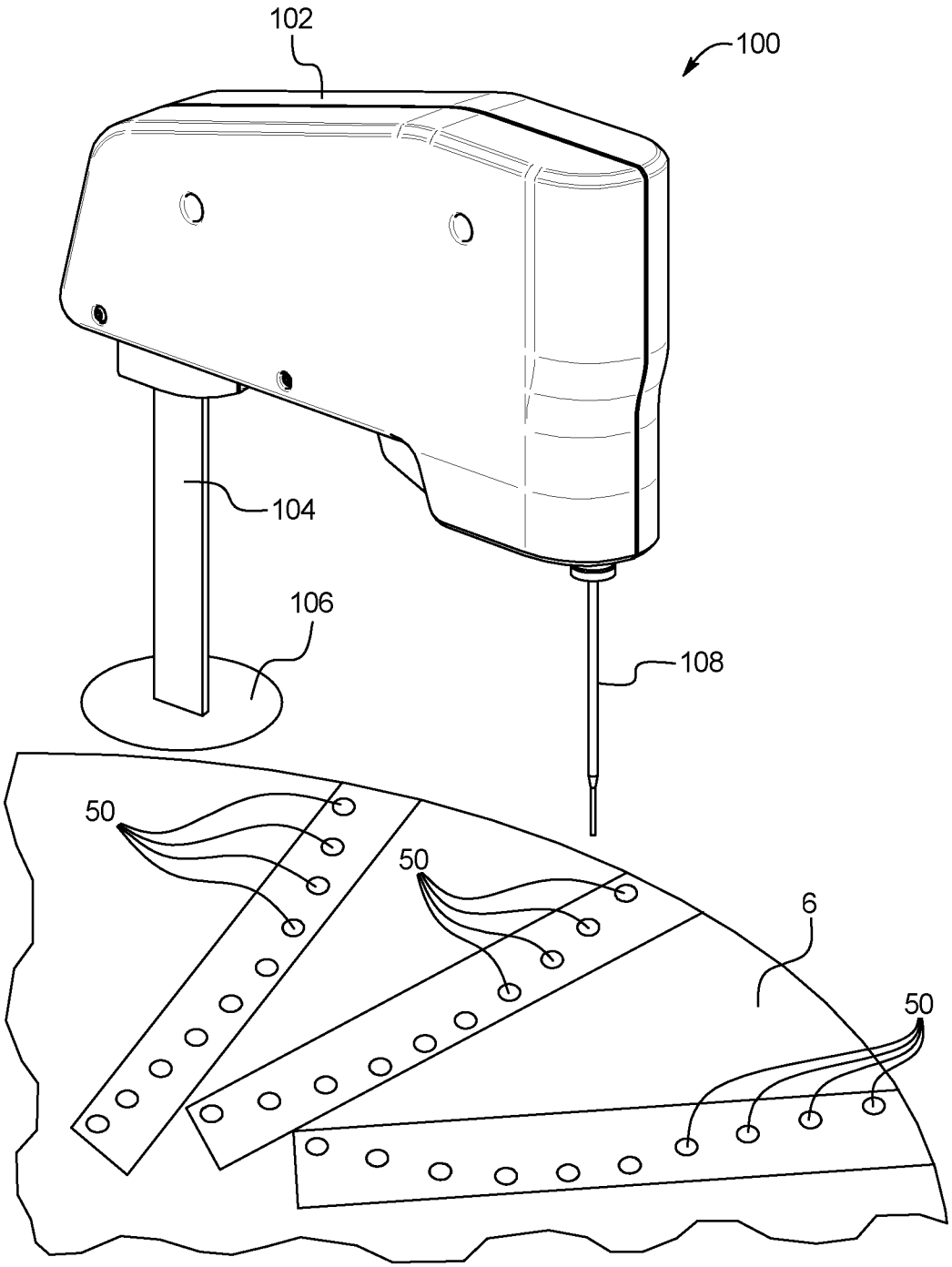
FIG. 2 is a perspective view of an example embodiment of a fluid dispensing and mixing device that can be used as a pipettor in FIG. 1.

In FIG. 2, device 100 is shown next to reaction rotor 6 to illustrate an example embodiment of how device 100 is configured to access the cuvettes 50 of system 1. In the illustrated embodiment, device 100 includes an a rod 104 that rotates around a base 106, enabling pipette 108 to be positioned over any of the plurality of cuvettes 50 by rotating rod 104 and/or reaction rotor 6. Once positioned over a desired cuvette 50, rod 104 may be lowered into base 106, causing pipette 108 to also be lowered into the desired cuvette 50. Then a positive or negative pneumatic force may be to be used to aspirate fluid into and/or dispense fluid from pipette 108 using tube 110 (FIGS. 4 and 5), and/or a fluid may be delivered to cuvette 50 from a fluid reservoir (not shown) located at an opposite end of a tube 110 (FIGS. 4 and 5) placing the fluid reservoir in fluid communication with pipette 108. In an embodiment, tube 110 may include multiple tubes or flow paths connected to pneumatic and/or fluid sources. In another embodiment, pipette 108 may be a stirrer which does not aspirate and/or dispense fluid.

Figure 3:
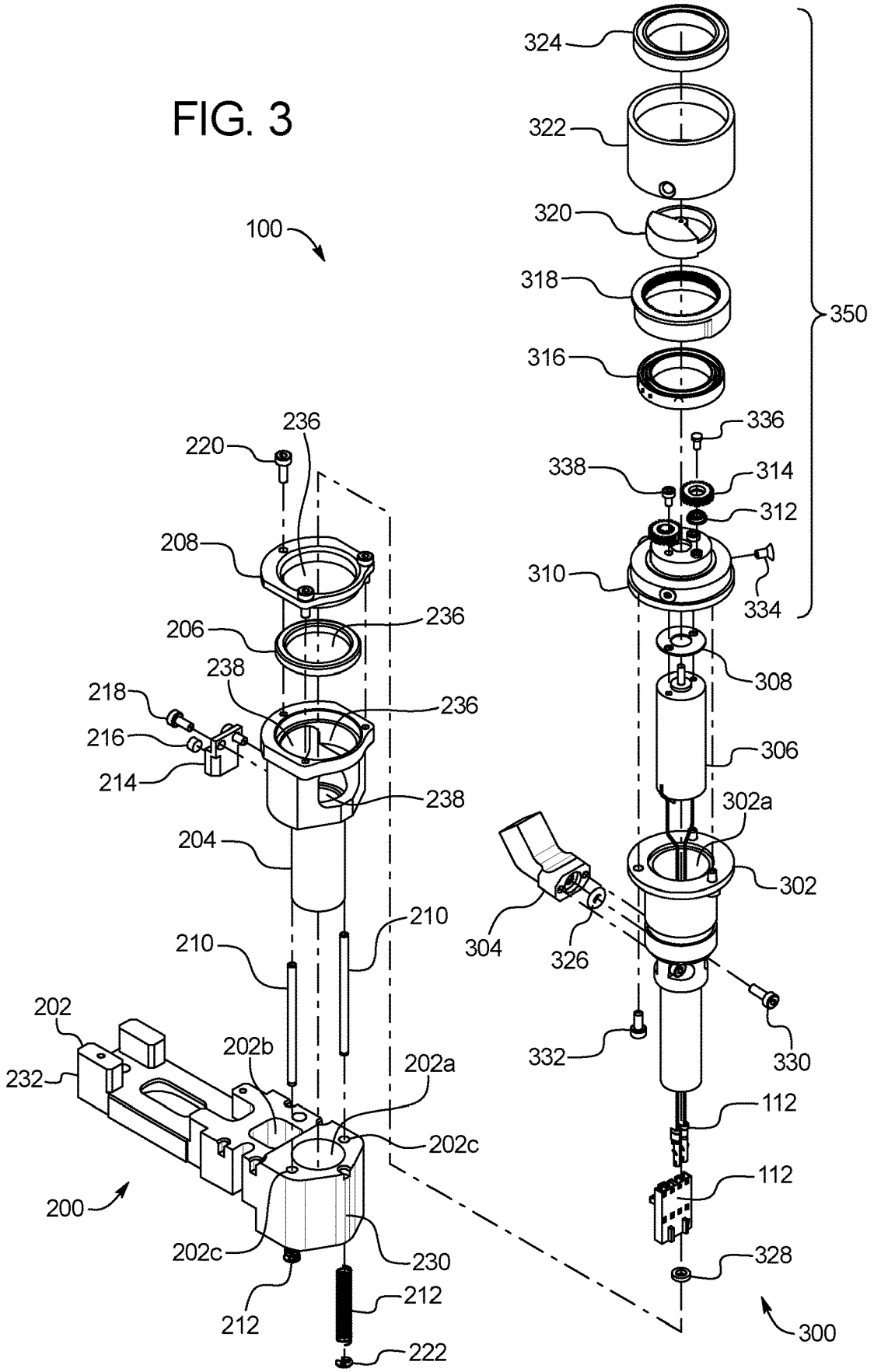
FIG. 3 is an exploded view of the inner components of the fluid dispensing and mixing device of FIG. 2.
Figure 5:
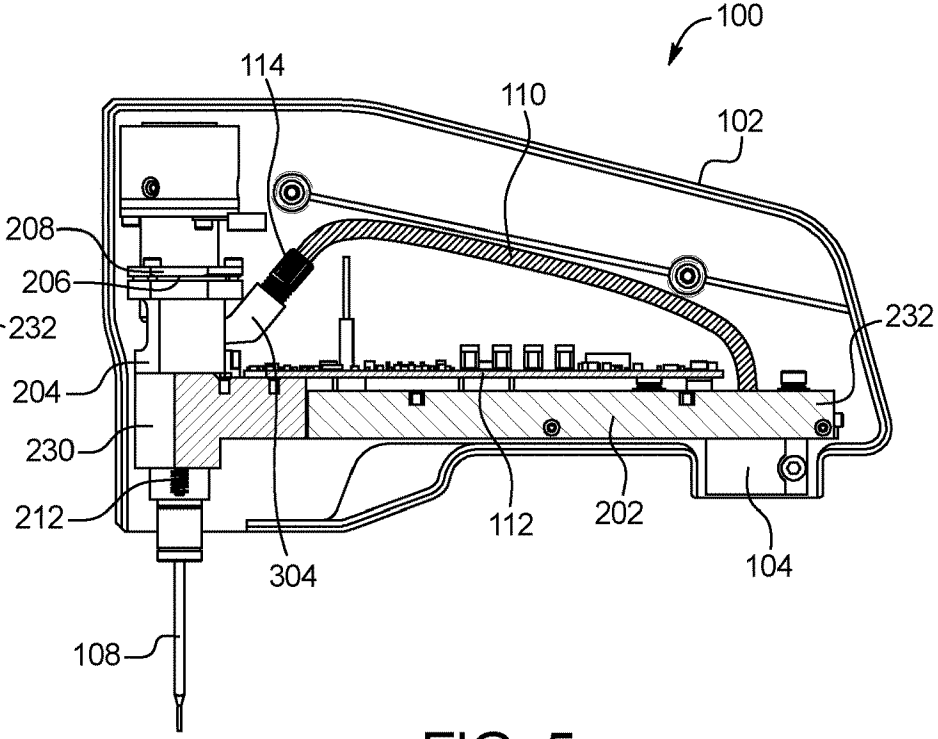
FIG. 5 is a side view of the inner components of the fluid dispensing and mixing device of FIG. 2.
Figure 4:
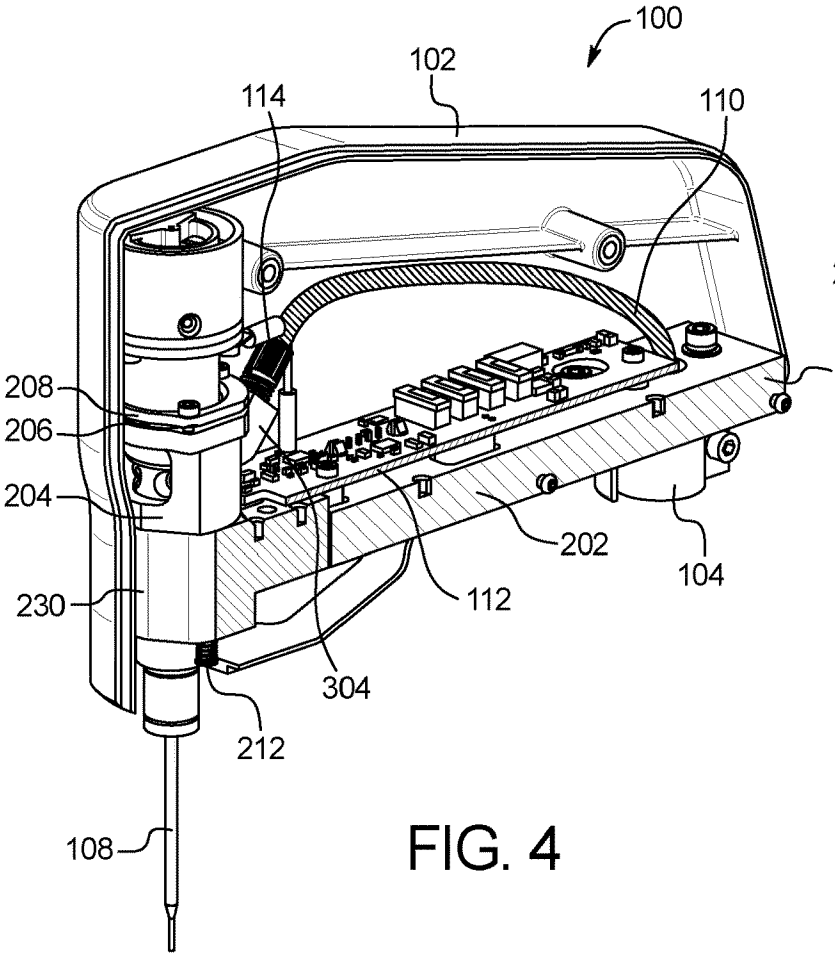
FIG. 4 is a front perspective view of the inner components of the fluid dispensing and mixing device of FIG. 2.
Figure 6:
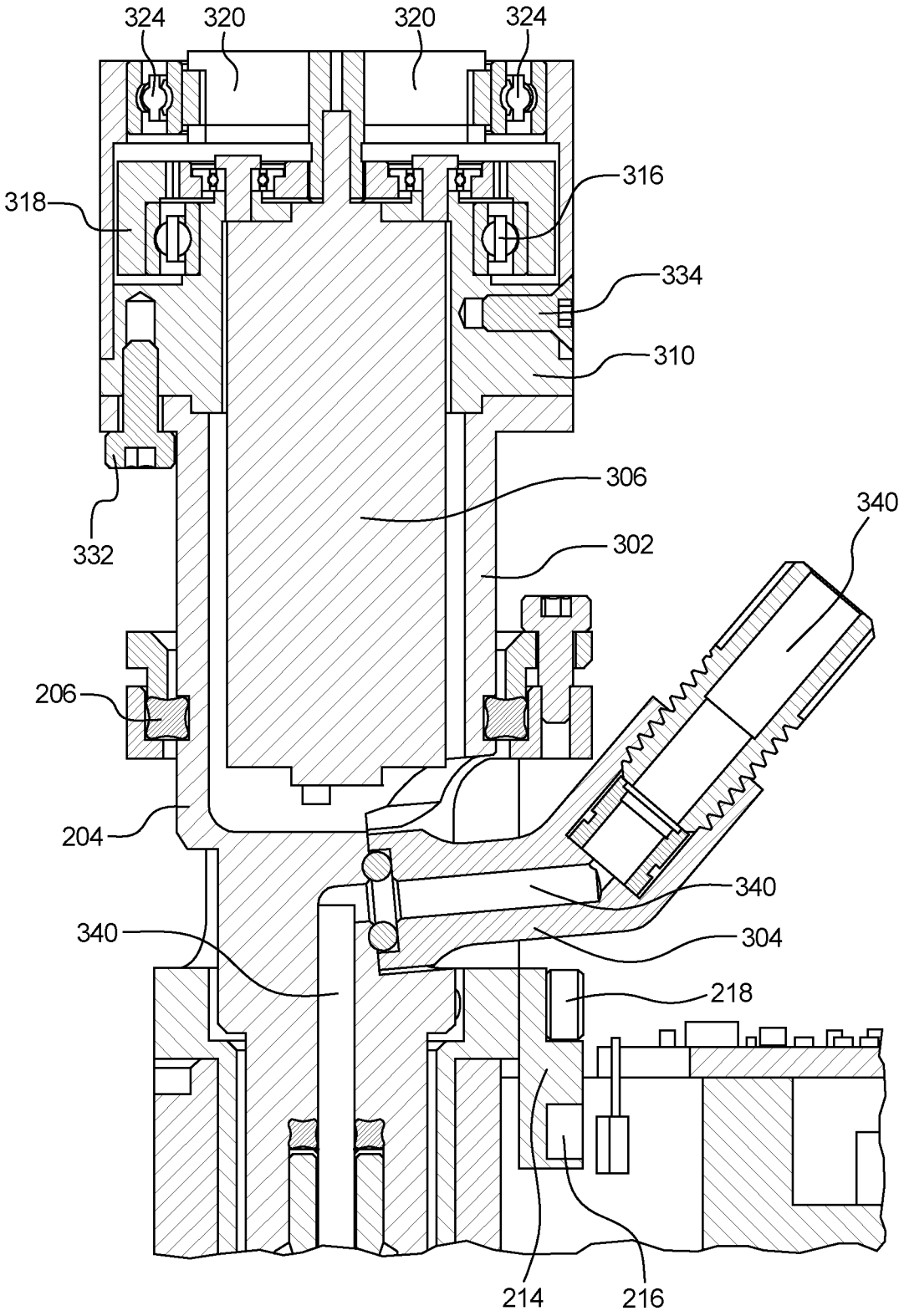
FIG. 6 is a side cross-sectional view of the fluid dispensing and mixing device of FIG. 2.

FIGS. 3 to 6 illustrate an example embodiment of device 100 in more detail. FIG. 3 shows an exploded view of the internal components of device 100 (omitting pipetting assembly 400), FIGS. 4 and 5 show the assembled components of device 100 with cover 102 partially removed, and FIG. 6 shows a partial cross-sectional view illustrating the flow path through device 100. In the illustrated embodiment, device 100 may include a base assembly 200, a motor assembly 300 and a pipetting assembly 400. Each of these assemblies and their specific components are discussed in more detail below.

In the illustrated embodiment, base assembly 200 includes a main bracket 202, a sleeve 204, an o-ring 206 (e.g., 16 mm inner diameter), a cover 208, a pair of shafts 210 and corresponding springs 212, a secondary bracket 214, a magnet 216 (e.g., 3 mm diameter, 2 mm height), and a plurality of screws 218, 220 and retaining rings 222. In use, base assembly is configured to retain motor assembly 300 and pipetting assembly 400 and enable rotation of device 100 using rod 104 so that fluid may be aspirated from and/or dispensed into various cuvettes 50 from pipetting assembly 400. Base assembly 200 also provides a dislodgement detection subassembly 250, discussed in more detail below, for determining if pipette 108 has become dislodged, for example, if device 100 is lowered so as to cause pipette 108 to contact the bottom of a cuvette 50.

In the illustrated embodiment, main bracket 202 includes a first end 230 and a second end 232. Main bracket 202 retains motor assembly 300 and pipetting assembly 400 at first end 230, and attaches to rod 104 at second end 232 to enable rotation of motor assembly 300 and pipetting assembly 400 so as to align with different cuvettes 50. In the illustrated embodiment, sleeve 204 is inserted into a first aperture 202*a* at first end 230 of main bracket 202. O-ring 206 is placed around an aperture at the top portion of sleeve 204, and is sandwiched between sleeve 204 and cover 208 using screws 220 passing through apertures in cover 208 and into corresponding apertures in sleeve 204. Those of ordinary skill in the art will recognize other methods of attaching main bracket 202, sleeve 204, o-ring 206 and/or cover 208.

Before sleeve 204 is placed into first aperture 202*a*, secondary bracket 214 and magnet 216 are attached to sleeve 204 with screws 218. As sleeve 204 is placed into first aperture 202*a*, secondary bracket 214 aligns with second aperture 202*b* of main bracket 202, creating dislodgement detection subassembly 250 in combination with the pair of shafts 210 and corresponding springs 212 inserted through third apertures 202*c* in main bracket 202. The dislodgement detection subassembly 250 is discussed in more detail below.

In the illustrated embodiment, motor assembly 300 includes a mixing adaptor 302, a fluid line adaptor 304, a mixing motor 306, a gasket 308 (e.g., silicon), and a gear assembly 350. In use, motor assembly 300 places pipetting assembly 400 in fluid communication with pneumatics and/or a source of fluid via tube 110, and/or enables pipetting assembly 400 to be displaced within cuvette 50 to mix the fluid within a cuvette 50 and/or break up clusters of paramagnetic particles.

In the illustrated embodiment, mixing adaptor 302 is placed into upper aperture 236 formed by sleeve 204, o-ring 206 and cover 208. Fluid line adaptor 304 is then screwed into mixing adaptor 302 through side aperture 238 of sleeve 204 with screw 330, with o-ring 326 (e.g., silicon, 2.2 mm inner diameter, 1.6 mm width) sandwiched between fluid line adaptor 304 and mixing adaptor 302, creating a fluid path 340 (e.g., shown in FIG. 6) extending from fluid line adaptor 304 into mixing adaptor 302 and through pipette 108 (e.g., shown in FIG. 8B). Those of ordinary skill in the art will recognize other suitable methods of attaching mixing adaptor 302, fluid line adaptor 304 and/or o-ring 306. Mixing motor 306 is placed into an aperture 302*a* of mixing adaptor 302, and is then sandwiched between mixing adaptor 302 and gear assembly 350 after receiving gasket 308 by the tightening of screws 332 through mixing adaptor 302 and housing 310 of gear subassembly 350.

Figure 8B:
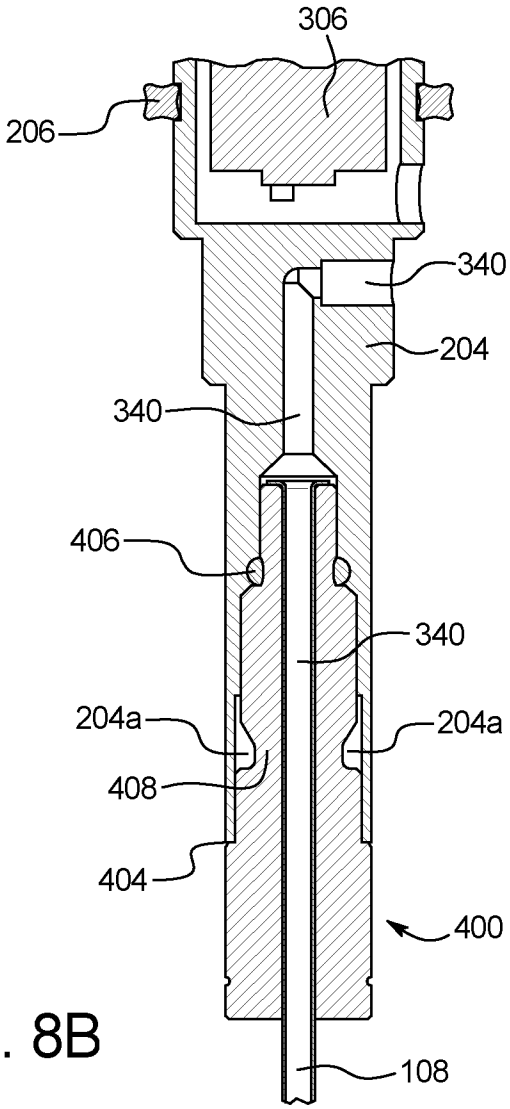
FIGS. 8A and 8B illustrate the placement of an example embodiment of a pipetting assembly of the fluid dispensing and mixing device of FIG. 2.
Figure 10B:
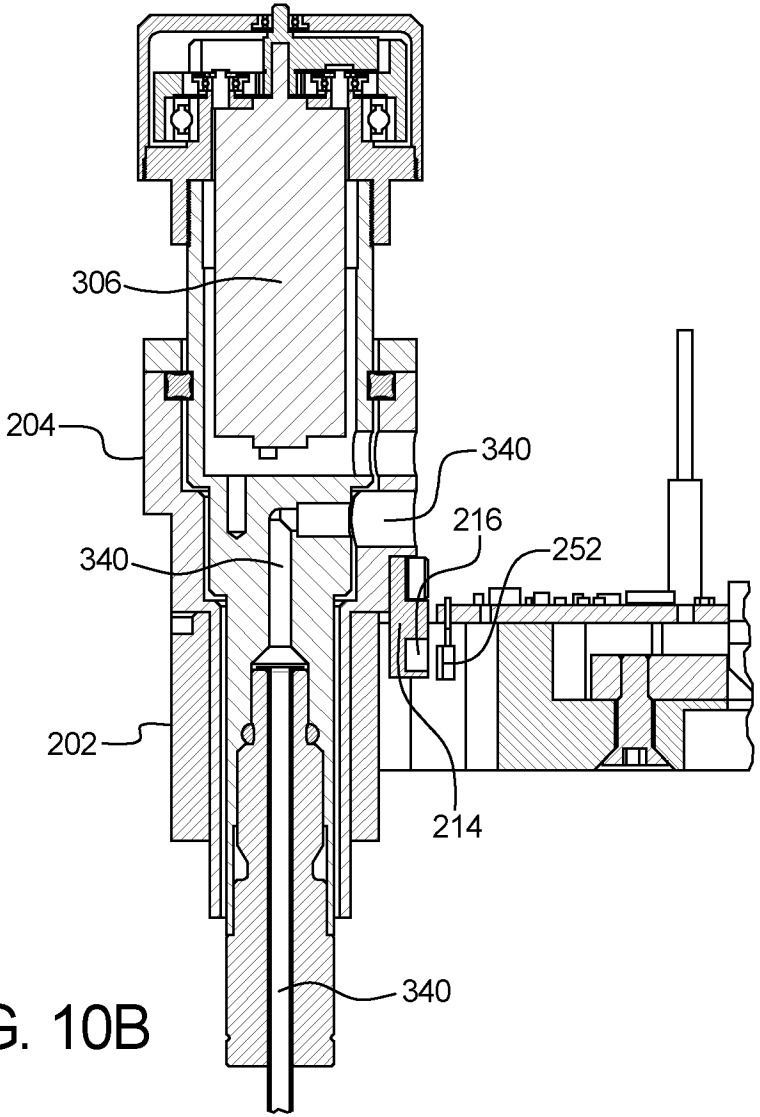
FIGS. 10A and 10B illustrate an example embodiment of a dislodgment detector for the fluid dispensing and mixing device of FIG. 2.

As illustrated in FIGS. 4 to 6, attachment of fluid line adaptor 304 to mixing adaptor 302 creates a flow path 340, which extends through pipette 108 of pipetting assembly 400 when pipetting assembly 400 is attached as shown in FIGS. 8B and 10B. Tube 110 can then be located through the center of rod 104 and attached to fluid line adaptor 304, for example via connector 114, to place pipette 108 in fluid communication with a pneumatic source of system 1 to enable fluid to be aspirated into and/or dispensed from pipette 108 by controlling the pneumatic source to cause a positive or negative pneumatic pressure through tube 110. In another embodiment, tube 110 may be placed in fluid communication with a fluid reservoir (not shown) so that fluid from the fluid reservoir can be pumped through tube 110 and out of pipette 108 and/or aspirated into pipette 108 and through tube 110 to the fluid reservoir.

FIGS. 7A to 7F illustrate the assembly of an example embodiment of gear subassembly 350 of motor assembly 300. In the illustrated embodiment, gear subassembly 350 includes a housing 310, a pair of flange ball bearings 312 (e.g., 1.5 mm inner diameter), a pair of gears 314, a first ball bearing 316 (e.g., 15 mm inner diameter, 21 mm outer diameter), a first nonconcentric mass 318, a second nonconcentric mass 320, a cap 322, and a second ball bearing 324 (e.g., 17 mm inner diameter, 23 mm outer diameter).

Figure 7C:
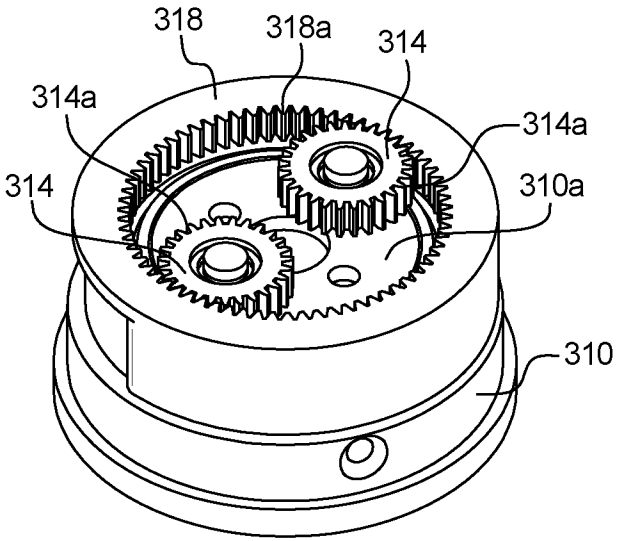
FIGS. 7A to 7F illustrate the assembly of an example embodiment of a gear subassembly of the fluid dispensing and mixing device of FIG. 2.
Figure 7B:
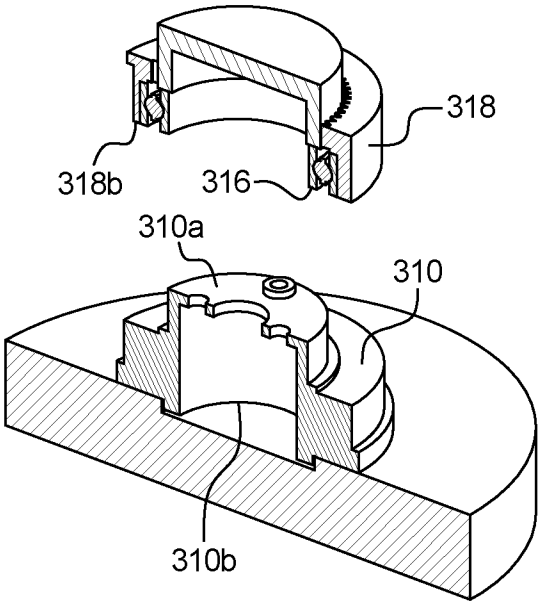
Figure 7A:
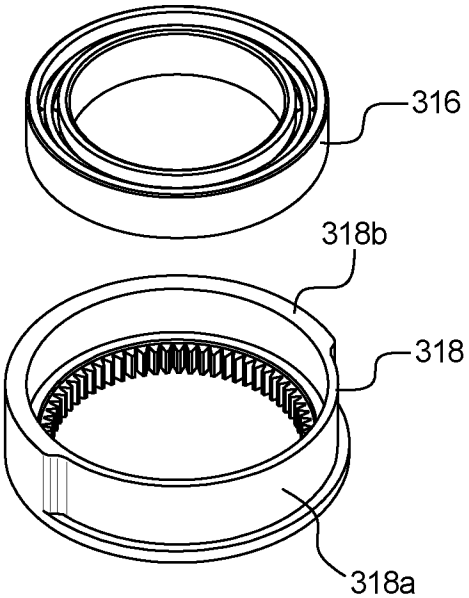

In FIG. 7A, first ball bearing 316 is placed into first nonconcentric mass 318 from the bottom 318*b* of first nonconcentric mass 318. As illustrated, first nonconcentric mass 318 includes an indentation 318*a* on an outer perimeter thereof, creating a mass imbalance as first nonconcentric mass 318 rotates. Those of ordinary skill in the art will recognize that the mass imbalance of first nonconcentric mass 318 can be created in other ways besides indenting the outer perimeter of first nonconcentric mass 318, for example, indenting, extending or adding or subtracting weight to or from another portion of first nonconcentric mass 318 such that first nonconcentric mass 318 is physically nonconcentric and/or nonsymmetrical and/or weighted nonconcentrically and/or nonsymmetrically. In other words, first nonconcentric mass 318 is nonconcentric in that it creates an imbalance during rotation due to physical structures/weights that are distributed differently from the center. In the illustrated embodiment, indentation 318*a* is made in less than 50% of the perimeter of first nonconcentric mass 318. In an embodiment, first nonconcentric mass 318 has a mass between about 4 to 8 grams, between about 5 to 7 grams, about 6 grams, or about 6.19 grams, has a radius to the central axis of about 1 to 2 mm, about 1.5 mm, or about 1.44 mm, and its center of mass is positioned about 25 to 30 mm, about 26 to 28 mm, about 27 to 28 mm, or about 27.5 mm above the center of mass of the overall mixing device.

In FIG. 7B, first nonconcentric mass 318 and first ball bearing 316 are inserted onto housing 310 so as to be located around an upward protrusion 310*a* of housing 310. Placement of first ball bearing 316 around upward protrusion 310*a* enables first nonconcentric mass 318 to rotate freely around upward protrusion 310*a*. As illustrated, housing 310 includes an aperture 310*b* therethrough to allow mixing motor 306 to communicate with components of gear subassembly 350 placed above housing 310, as explained in more detail below.

In FIG. 7C, gears 314 are placed onto the upper surface of protrusion 310*a* so that teeth 314*a* of gears 314 contact corresponding teeth 318*a* of first nonconcentric mass 318. In an embodiment, bearings 312 are also placed between housing 310 and gears 318 to facilitate movement of gears 318. In an embodiment, the upper surface of protrusion 310*a* of housing 310 may also be curved so as to minimize points of contact between gears 318 and housing 310 to facilitate movement of gears 318.

Figure 7F:
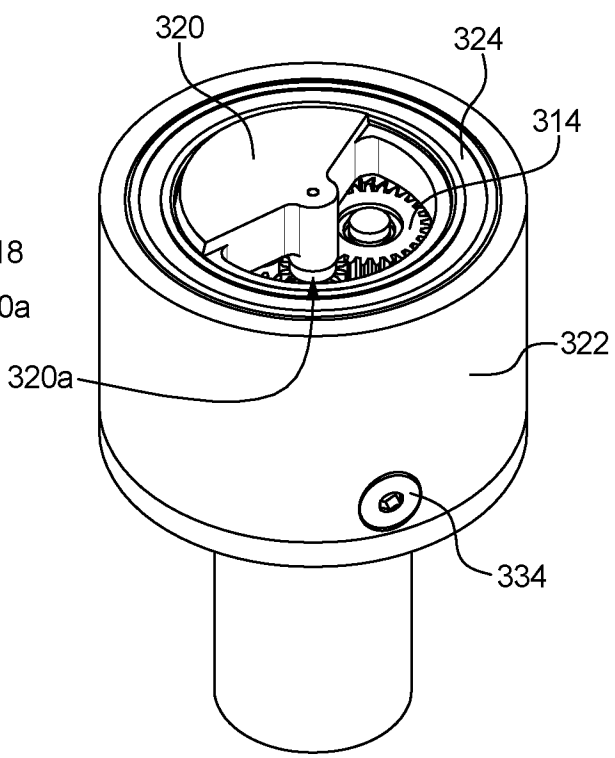
Figure 7E:
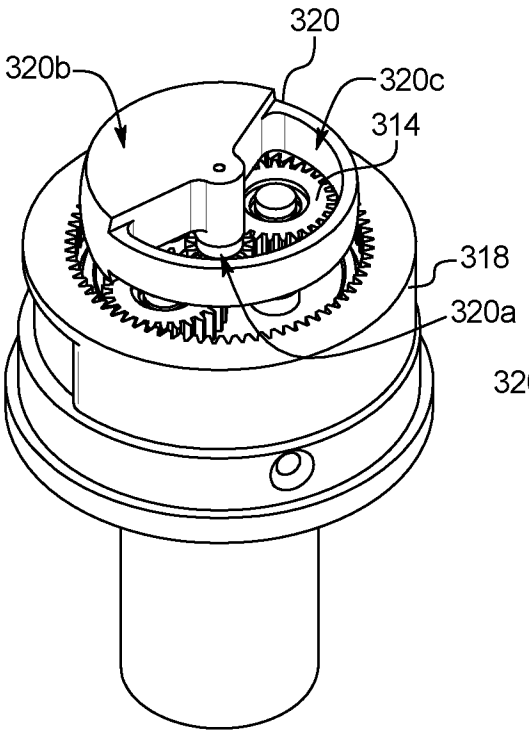
Figure 7D:
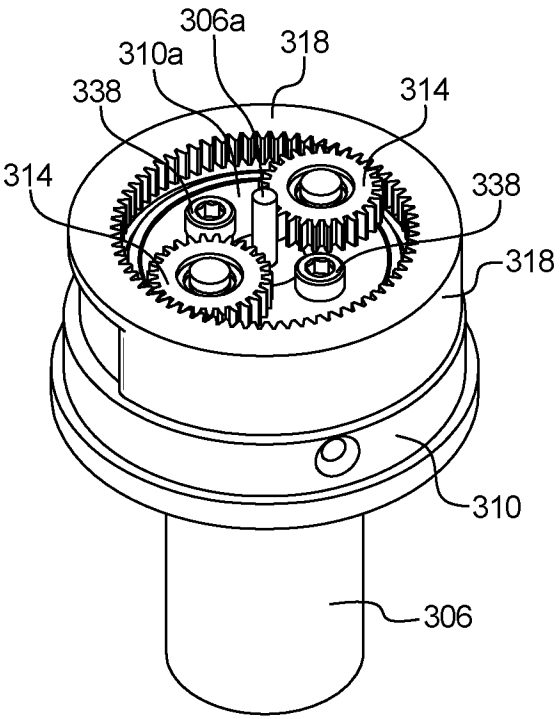

In FIG. 7D, housing 310 is placed over mixing motor 306 so that shaft 306*a* of motor 306 extends through aperture 310*b* of housing 310 to allow mixing motor 306 to drive gears 314, first nonconcentric mass 318 and a second nonconcentric mass 320. In the illustrated embodiment, screws 338 are placed through protrusion 310*a*, gasket 308 and mixing motor 306 to secure housing 310 to mixing motor 306.

In FIG. 7E, second nonconcentric mass 320 is placed over shaft 306*a* so that teeth of a lower gear 320*a* of second nonconcentric mass 320 contact corresponding teeth 314*a* of gears 314. As illustrated, second nonconcentric mass 320 includes a solid portion 320*b* and an open portion 320*c*, creating a mass imbalance as second nonconcentric mass 320 rotates. Those of ordinary skill in the art will recognize that the mass imbalance of second nonconcentric mass 320 can be created in other ways, for example, indenting, extending or adding or subtracting weight to or from another portion of second nonconcentric mass 320 such that second nonconcentric mass 320 is physically nonconcentrical and/or nonsymmetrical and/or weighted nonconcentrically and/or nonsymmetrically. In other words, second nonconcentric mass 320 is nonconcentric in that it creates an imbalance during rotation due to physical structures/weights that are distributed differently from the center. In the illustrated embodiment, solid portion 320*b* makes up less than 50% of the area of second nonconcentric mass 320 when viewed from the top, and open portion 320*c* makes up more than 50% of the area of second nonconcentric mass 320 when viewed from the top. In an embodiment, second nonconcentric mass 320 has a mass of about 3 to 6 grams, about 4 to 5 grams, about 4.5 grams or about 4.54 grams, has a radius to the central axis of about 1 to 4 mm, about 2 to 3 mm, about 2.5 mm or about 2.52 mm, and its center of mass is positioned about 31 to 36 mm, about 32 to 35 mm, about 33 to 34 mm, about 33.5 mm or about 33.45 mm above the center of mass of the overall mixing device.

In FIG. 7F, second ball bearing 324 is placed around second nonconcentric mass 320, and then cap 322 is placed over housing 310 so as to locate second ball bearing 324 between cap 322 and second nonconcentric mass 320, enabling second nonconcentric mass 320 to rotate freely with respect to cap 322. Cap 322 may then be tightened to housing 310, for example, using screws 334. Although cap 322 is shown without an upper surface, it should be understood that cap 322 may also include an upper surface to contain the components of gear subassembly 350 therein. In an embodiment, second ball bearing 324 may be formed of a ceramic material to provide electrical isolation between cap 322 and second nonconcentric mass 320, for example, for the purpose of detecting the moment pipette tip crosses air-liquid surface by observing pipette capacitance change. Electrically isolating second ball bearing 324 prevents inherent capacitance changes due to rotating masses to be confusing the liquid level crossing detector.

Figure 8A:
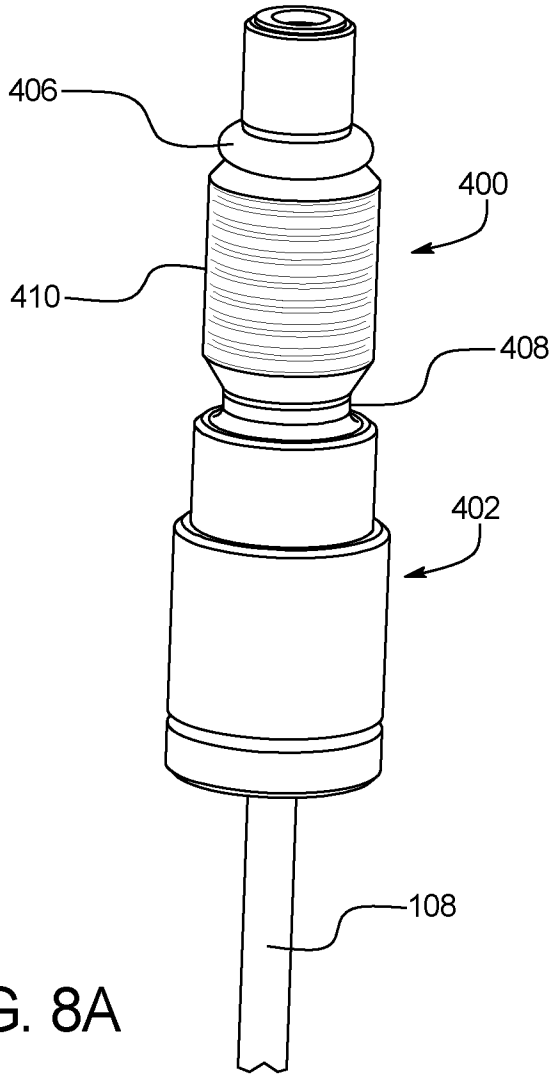
Figure 9:
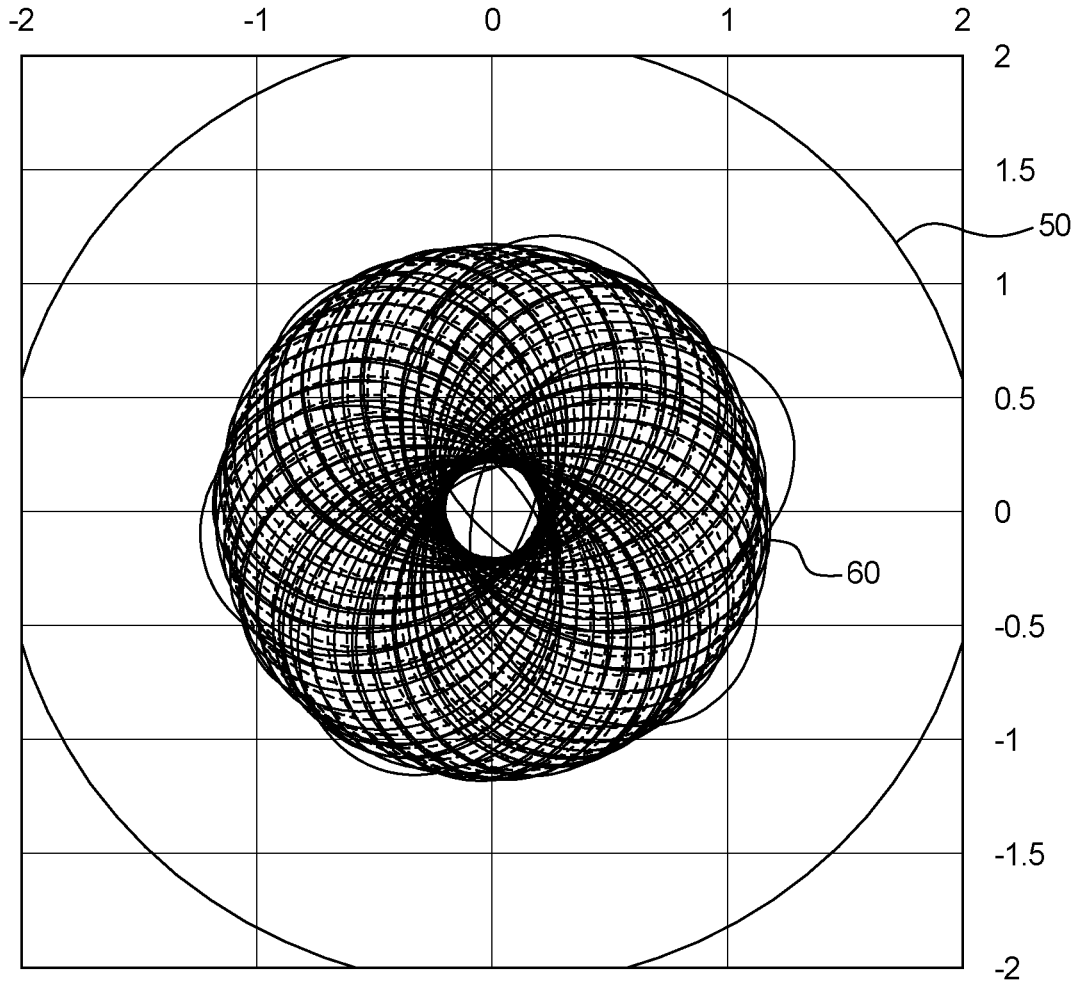
FIG. 9 illustrates a top view of an example embodiment of a mixing pattern formed by the pipette of the fluid dispensing and mixing device of FIG. 2.

FIG. 8A illustrates an example embodiment of pipetting assembly 400, while FIG. 8B shows pipetting assembly 400 placed inside sleeve 204 of base assembly 200. In the illustrated embodiment, pipetting assembly 400 includes an elongated body 402 having a stop 404, an o-ring 406, a mating feature 408, and threads 410, as well as pipette 108 extending therefrom. In use, pipetting assembly 400 is removably attached to base assembly 200 and motor assembly 300 so as to dispense fluid into and/or aspirate fluid from various cuvettes 50 and/or mix the fluid within the cuvette once dispensed/aspirated.

In the illustrated embodiment, mating feature 408 of elongated body 402 aligns with a corresponding mating feature 204*a* of sleeve 204 to allow a snap-fit as threads 410 are threaded to corresponding threads inside sleeve 204. The use of mating feature 408 and/or threads 410 enables simple detachment and replacement of pipetting assembly 400 with a new or different pipetting assembly 400 as needed. In the illustrated embodiment, mating feature 408 includes an indentation that aligns with a protrusion of mating feature 204*a*, but those of ordinary skill in the art will understand that mating feature 408 can include the protrusion and mating feature 204*a* can include the indentation, and/or other mating features may be used. Stop 404 may also be used to prevent pipetting assembly 400 from being threaded or otherwise inserted too far into sleeve 204.

When pipetting assembly 400 is attached to base assembly 200 and motor assembly 300, gear subassembly 350 may be used to cause pipette 108 to mix fluid and magnetic particles within a cuvette 50 in a way that breaks up clusters of magnetic particles in the cuvette. As illustrated, for example, in FIGS. 7A to 7E, shaft 306*a* may be rotated by mixing motor 306 to cause first nonconcentric mass 320 to rotate in the same direction as the motor rotation. When mass 320 is caused to rotate by the motor 306, lower gear 320*a* of second nonconcentric mass 320 likewise rotates in the same direction as motor 305's rotation direction, with teeth of lower gear 320*a* contacting corresponding teeth 314*a* of gears 314 and causing gears 314 rotating in an opposite direction. This motion then causes first nonconcentric mass 318 to rotate in the direction opposite to motor and second nonconcentric mass 320 rotation because teeth 314*a* of gears 314 contact corresponding teeth 318*a* of second nonconcentric mass 318 from the inner side of rotating mass 318.

Since both first nonconcentric mass 318 and second nonconcentric mass 320 are imbalanced masses, rotation of these nonconcentric masses 318, 320 causes pipette 108 to move within a cuvette 50 in a way that breaks up clusters of magnetic particles in the cuvette. In particular, rotation of these nonconcentric masses 318, 320 causes pipette 108 to simultaneously move in two different circular paths within cuvette 50 (e.g., creating a spirograph pattern or roulette curve pattern 60 when viewed from above), as illustrated for example by FIG. 9. That is, first nonconcentric mass 318 causes pipette 108 to move in a first circular pattern and second nonconcentric mass 320 causes pipette 108 to move in a second circular pattern, with one of the first and second circular patterns having a smaller or larger radius than the other of the first and second circular patterns, creating the spirograph pattern or roulette curve pattern 60 shown in FIG. 9. In the illustrated embodiment, the first circular pattern formed by first nonconcentric mass 318 has the larger radius, and the second circular pattern formed by second nonconcentric mass 320 has the smaller radius. As illustrated, this pattern causes the pipette 108 which would normally be centered within the cuvette 50 to sweep outwards towards walls of the cuvette to break up clusters of paramagnetic particles located against the walls. Recoil from second nonconcentric mass 320 rotating at higher frequency causes pipette tip move over the second circular pattern. A virtual center of second circular pattern is rotating in an opposite direction with a lower frequency along the first circular pattern having a larger radius because of inertial recoil from rotating first nonconcentric mass 318. Cumulative rotation angles of both patterns are synchronized by the teethed gears maintaining a constant ratio of these angles matching a rational number with a large enough mutually prime numerator and denominator. Described selection of the ratio ensures many sweeps of the second circular pattern through the first circular pattern generating a spirograph pattern resulting trajectory instead of a non-reproducible motion trajectory which would happen with non-synchronized rotation angles. Opposite rotation directions along two circular patterns ensures that each new slice of liquid is swept by pipette 108 (or another stirrer) on the way towards the outer walls of cuvette 50. A sweep of a slice of liquid mentioned is created because of a shift of the next orbit on the second circular pattern over the first circular pattern trajectory exposing previously undisturbed liquid to movement of pipette 108. Alternatively, if the same rotation directions were used, a new liquid slice would be swept towards the center of cuvette 50, reducing the efficiency of dislodging particles from outer walls of cuvette 50.

As further illustrated in FIG. 6, for example, o-ring 206 provides an elastic interface between base assembly 200 and mixing assembly 300, enabling the nonconcentric masses 318, 320 to cause the displacement of pipette 108. That is, o-ring 206 allows two degrees of freedom between base assembly 200 and mixing assembly 300. These degrees of freedom correspond to the tilt of mixing assembly 300 axis versus two orthogonal to each other horizontal axes. Vertical rotation of mixing assembly 300 versus base assembly 200 and any linear motion of base assembly 200 versus mixing assembly 300 is completely restricted.

In an embodiment, the rotation angle/frequency ratio between the faster rotating mass of the first and second nonconcentric masses and the slower rotating mass of the first and second nonconcentric masses should be between about 4:1 and 6:1, or between about 4.5:1 to 5:1, or between about 34:7 and 4.86:1. It is advantageous to keep such a ratio to generate a dense enough spirograph/roulette pattern covering the horizontal cross-section of cuvette 50 by trajectory loops staying at smaller than the pipette 108 tip radius distance from each other. This property is advantageous in disturbing liquid by the pipette 108 tip by cropping thin slices from a body of liquid, without splashing the liquid, while the pipette 108 tip gradually moves in the first and second circular pattern motions.

Figure 10A:
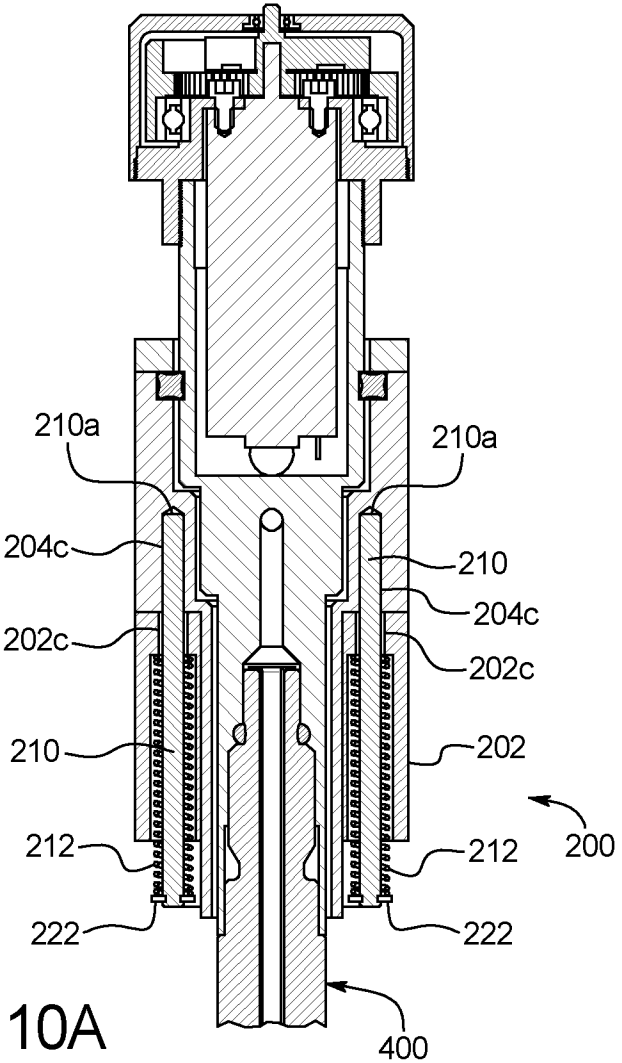

FIGS. 10A and 10B illustrate an example of a dislodgement detection subassembly 250 including secondary bracket 214, magnet 216, shafts 210 and springs 212, and magnet detector 252. In use, dislodgement detection assembly 250 is configured to determine when pipette 108 becomes dislodged, for example, if device 100 is lowered so as to cause pipette 108 to contact the bottom of a cuvette 50 and/or before, during or after activation of motor assembly 300.

In the illustrated embodiment, each shaft 210 is positioned to extend through third apertures 202*c* in main bracket 202 and into corresponding apertures 204*c* in sleeve 204 such that the tip 210*a* extends into corresponding apertures 204*c* of sleeve 204 and abuts a surface of sleeve 204. Springs 212 are then positioned around shafts 210 and compressed so as to provide a downward force onto fluid assembly 400. Springs 212 may be secured, for example, with retaining rings 222. At the same time, secondary bracket 214 positions magnet 216 adjacent to a corresponding magnet detector 252.

If device 100 is lowered so as to cause pipette 108 to contact the bottom of a cuvette 50 or other horizontal surface in case of misalignment or motion failure, then pipette 108 is pushed upwards against sleeve 204. The entire assembly (e.g., FIG. 3, excl. 230) is pushed upwards against the forces of gravity and the springs 212. When sleeve 204*a* moves upward, second bracket 214 attached thereto also moves upward, dislodging magnet 216 from being adjacent to magnet detector 252, thereby causing magnet detector 252 to cause a signal indicating dislodgement. Although magnet 216 is used in the illustrated embodiment, those of ordinary skill in the art should recognize that other types of proximity sensors may be used.

In an embodiment, automated immunochemistry system 1 and/or device 100 can also include a control unit that causes pipette 108 to aspirate/dispense fluid and vibrate to mix fluid and paramagnetic particles within a cuvette 50. The control unit can accompany or be a part of automated immunochemistry system 1 and/or device 100, or can be located remotely and communicate with automated immunochemistry system 1 and/or device 100 via a wireless or wired data connection. The control unit can include circuitry 112 including a processor and a memory, which can include a non-transitory computer readable medium.

Figure 11:
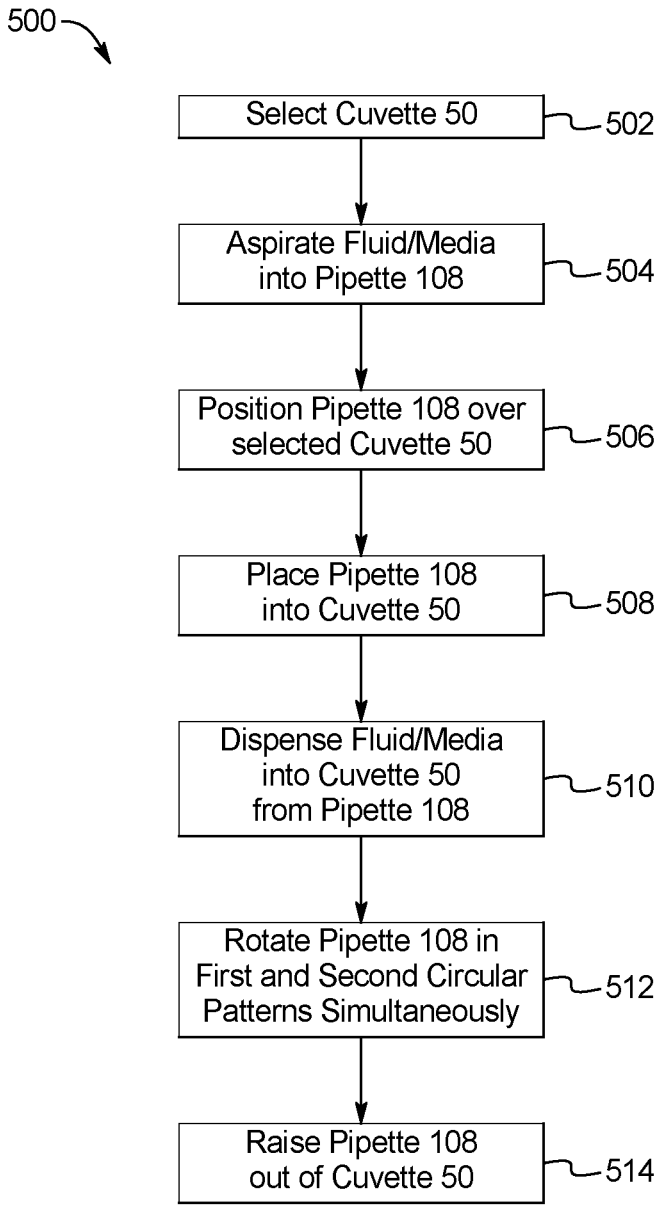
FIG. 11 illustrates an example embodiment of a control method that can be performed by the fluid dispensing and mixing system of FIG. 2.

FIG. 11 shows a control method 500 for using device 100 with automated immunochemistry system 1. The control method 500 can be performed automatically by the control unit, which can control the movement of device 100 and the individual elements thereof according to the steps of control method 500 and/or or instructions entered by a user. In an embodiment, the control unit can include a database with the locations of fluids and paramagnetic particles stored within the rotors of automated immunochemistry system 1, and can cause device 100 to rotate and translate pipette 108 to the locations depending on the type of assay being run by the user. The control unit can also control the voltage delivered to mixing motor 306 to vibrate pipette 108, and can control the pneumatic force and/or fluid sent through tube 110 to aspirate/dispense fluid samples.

In an embodiment, control method 500 begins after paramagnetic particles have already been dispensed within a cuvette, and after a magnetic force has been applied to and removed from the cuvette 50, causing the paramagnetic particles to cluster. For example, R1 pipettor 4 can dispense paramagnetic particles into cuvette 50 and then a magnetic force can be applied to and removed from cuvette 50. Control method 500 can then be performed by dispensing another fluid into cuvette 50 with R1 pipettor 4 or any of the other pipettors discussed above. In another embodiment, pipette 108 can dispense and mix the paramagnetic particles in accordance with control method 500. For example, R1 pipettor 4 can dispense the paramagnetic particles into cuvette 50 and then mix the paramagnetic particles before or after a magnetic force is applied to and/or removed from cuvette 50.

At step 502 of control method 500, a cuvette 50 within reaction rotor 14 is selected for the disbursement of fluid/media. The selection can be made by a user or can automatically be made by a control unit. In an embodiment, a user can simply select a desired assay to be run on a patient sample via a user interface, and the control unit can select an appropriate cuvette based on the selected assay and/or based on an available cuvette 50.

Optionally, at step 504, the control unit can cause pipette 108 to aspirate fluid/media from a rotor of automated immunochemistry system 1, for example, by applying a negative pneumatic force to tube 110 to draw the fluid/media into pipette 108. The fluid can be, for example, a patient sample, a capture reagent or a rinse buffer. The media can be, for example, paramagnetic particles. For example, in an embodiment in which sample pipettor 20 includes device 100, pipette 108 can aspirate a patient sample from sample rotor 18 so that the patient sample can then be injected into cuvette 50.

At step 506, pipette 108 is positioned over the selected cuvette 50. The positioning can be accomplished by rotating and/or translating pipette 108 to be located over the selected cuvette 50, by rotating and/or translating cuvette 50 to be located under pipette 108, or by rotating and/or translating both of pipette 108 and cuvette 50 as shown in the illustrated embodiment. The rotation and translation can be automatically controlled by the control unit. In the illustrated embodiment, rod 104 rotates about base 106 to rotate pipette 108 to be located at different positions over reaction rotor 14, while reaction rotor 14 rotates to locate cuvettes 50 to be near pipette 108.

At step 508, the tip of pipette 108 is placed into cuvette 50. The placement of pipette 108 into cuvette 50 can be accomplished by lowering pipette 108 and/or by raising cuvette 50. In the illustrated embodiment, cuvette 50 remains stationary once positioned underneath pipette 108, and pipette 108 is lowered into cuvette 50. In the illustrated embodiment, rod 104 is translated upward and downward with respect to base 106 to translate pipette 108 upward and downward. In an alternative embodiment, device 100 can include a translational assembly having a motor that lowers pipette 108 into cuvette 50 while the rest of device 100 remains stationary.

At step 510, fluid/media is dispensed from pipette 108 into cuvette 50. The fluid/media can be dispensed, for example, by the control unit causing a positive pneumatic force to be applied through tube 110, or by the control unit causing a fluid be delivered from a fluid reservoir through tube 110. In an embodiment, cuvette 50 already contains paramagnetic particles at this point and the paramagnetic particles have already been subjected to a magnetic force which has caused the paramagnetic particles to cluster within cuvette 50. For example, in an embodiment in which sample pipettor 20 includes device 100, pipette 108 can inject a patient sample from sample rotor 18 into cuvette 50. In another embodiment, in which sample R1 pipettor 4 and/or R2 pipettor 22 includes device 100, pipette 108 can inject a capture reagent into cuvette 50. In other embodiments, pipette 108 injects the paramagnetic particles into cuvette 50 and then mixes the paramagnetic particles within cuvette 50, pipette 108 injects a rinse buffer into cuvette 50, or pipette 108 injects and mixes fluid as it is moving vertically to minimize contact of the sample with the outer surface of pipette 108.

At step 512, pipette 108 remains within cuvette 50 so that at least a portion of pipette 108 is submerged below the surface of the fluid/media located in cuvette 50. The control unit then activates mixing motor 306, causing shaft **306*a* to rotate second nonconcentric mass 320 in a first direction, with teeth of lower gear 320*a* contacting corresponding teeth 314*a* of gears 314 and causing gears 314 to rotate in a second direction opposite of the first direction, thereby causing first nonconcentric mass 318 to rotate in the first direction as teeth 314*a* of gears 314 contact corresponding teeth 318*a* of first nonconcentric mass 318. In doing so, control unit causes both first nonconcentric mass 318 and second nonconcentric mass 320 to move pipette 108 to simultaneously in two different circular paths within cuvette 50 (e.g., creating a spirograph pattern or roulette curve pattern 60 when viewed from above), so as to sweep outwards towards walls of the cuvette 50** to densely break up clusters of paramagnetic particles located against the walls.

At step 514, pipette 108 is removed from cuvette 50. The removal of pipette 108 from cuvette 50 can be accomplished by raising pipette 108 and/or by lowering cuvette 50. In the illustrated embodiment, cuvette 50 remains stationary, and pipette 62 is raised from cuvette 50 by translating rod 104 upward with respect to base 106. In an alternative embodiment, a translational assembly can raise pipette 108 from cuvette 50 while the rest of device 100 remains stationary.

Although the present disclosure is relates to displacement of a dispensing/aspirating pipette within a cuvette, it should be understood that the present disclosure may be applied to stirrers besides a pipette. For example, mixing assembly 300 could instead be used to displace a stirrer that does not dispense or aspirate fluid to simultaneously move in two different circular paths within a cuvette (e.g., creating a spirograph pattern or roulette curve when viewed from above), so as to sweep outwards towards walls of the cuvette to break up clusters of paramagnetic particles located against the walls.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

The terms "a" and "an" and "the" and similar referents used in the context of the disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided herein is intended merely to better illuminate the disclosure and does not pose a limitation on the scope of the disclosure otherwise claimed. No language in the specification should be construed as indicating any non-claimed element essential to the practice of the disclosure.

The use of the term "or" in the claims is used to mean "and/or" unless explicitly indicated to refer to alternatives only or the alternatives are mutually exclusive, although the disclosure supports a definition that refers to only alternatives and "and/or."

Groupings of alternative elements or embodiments of the disclosure disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is herein deemed to contain the group as modified thus fulfilling the written description of all Markush groups used in the appended claims.

Preferred embodiments of the disclosure are described herein, including the best mode known to the inventors for carrying out the disclosure. Of course, variations on those preferred embodiments will become apparent to those of ordinary skill in the art upon reading the foregoing description. The inventor expects those of ordinary skill in the art to employ such variations as appropriate, and the inventors intend for the disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the disclosure so claimed are inherently or expressly described and enabled herein.

Further, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

The invention is claimed as follows:

1. A mixing device for an immunochemistry system, the mixing device comprising:

a base assembly including a pipette assembly and a motor assembly having a motor and a shaft;

a pneumatic source;

a pipette mechanically coupled to the pipette assembly and fluidly coupled to the pneumatic source, the pipette in conjunction with the pneumatic source configured to aspirate fluid and/or paramagnetic particles from or dispense fluid and/or paramagnetic particles into a cuvette;

a first nonconcentric mass coupled to the motor assembly, the motor configured to rotate the first nonconcentric mass about the shaft creating an imbalance during rotation that causes the pipette to move in a first mixing motion;

a second nonconcentric mass coupled to the motor assembly, the motor configured to rotate the second nonconcentric mass about the same shaft creating a second imbalance during rotation that causes the pipette to move in a second mixing motion that has a smaller degree of movement than the first mixing motion; and a control unit electronically coupled to the motor and configured to rotate the first nonconcentric mass and the second nonconcentric mass using the motor while the pipette is located within the cuvette so as to mix the fluid and/or paramagnetic particles within the cuvette.

2. The mixing device of claim 1, wherein the first nonconcentric mass is configured to cause the pipette to move in a first circular pattern and the second nonconcentric mass is configured to cause the pipette to move in a second circular pattern, the second circular pattern having a larger radius than the first circular pattern, and wherein the control unit is configured to activate the first and second nonconcentric masses via the motor to cause the pipette to move in the first circular pattern and the second circular pattern simultaneously.

3. The mixing device of claim 2, wherein rotation of one of the first and second nonconcentric masses causes rotation of the other of the first and second nonconcentric masses.

4. The mixing device of claim 2, wherein the first and second nonconcentric masses rotate in opposite directions.

5. The mixing device of claim 2, wherein the first and second nonconcentric masses rotate about the same axis.

6. The mixing device of claim 1, wherein at least one of the first nonconcentric mass or the second nonconcentric mass is physically nonconcentric, creating an imbalanced mass when rotated.

7. The mixing device of claim 1, wherein at least one of the first nonconcentric mass or the second nonconcentric mass includes an indentation on an outer perimeter thereof.

8. The mixing device of claim 1, wherein at least one of the first nonconcentric mass or the second nonconcentric mass includes a solid portion and an open portion.

9. The mixing device of claim 1, wherein at least one of the first nonconcentric mass or the second nonconcentric mass is weighted nonconcentrically, creating an imbalanced mass when rotated.

10. The mixing device of claim 1, which includes a dislodgement detection subassembly configured to determine if the pipette has become dislodged.

11. A mixing device for an immunochemistry system, the mixing device comprising:

a base assembly including a first assembly and a second assembly having a motor and a shaft;

a stirrer mechanically coupled to the first assembly and configured to translate into a cuvette via vertical movement of the base assembly;

a first nonconcentric mass coupled to the first assembly, the motor configured to rotate the first nonconcentric mass about the shaft creating a first imbalance during rotation that causes the stirrer to move in a first circular pattern;

a second nonconcentric mass coupled to the first assembly, the motor configured to rotate the second nonconcentric mass about the same shaft creating a second imbalance during rotation that causes the stirrer to move in a second circular pattern, the second circular pattern having a smaller radius than the first circular pattern; and a control unit electronically coupled to the motor and configured to rotate the first and second nonconcentric masses using the motor to cause the stirrer to move within the cuvette in the first circular pattern and the second circular pattern simultaneously.

12. The mixing device of claim 11, wherein the stirrer includes a pipette.

13. The mixing device of claim 11, wherein the control unit is configured to rotate the first and second nonconcentric masses to cause the stirrer to move in a spirograph pattern.

14. The mixing device of claim 11, wherein the control unit is configured to rotate the first and second nonconcentric masses to cause the stirrer to move in a roulette curve pattern.

15. The mixing device of claim 1, wherein the motor assembly includes at least one bearing and at least one gear mechanically coupled to the motor and at least one of the first nonconcentric mass or the second nonconcentric mass.

16. The mixing device of claim 11, wherein the first and second nonconcentric masses are configured to at least one of rotate in opposite directions or rotate about the same axis.

17. The mixing device of claim 11, wherein at least one of the first nonconcentric mass or the second nonconcentric mass is physically nonconcentric, creating an imbalanced mass when rotated.

18. The mixing device of claim 11, wherein at least one of the first nonconcentric mass or the second nonconcentric mass includes at least one of an indentation on an outer perimeter thereof or a solid portion and an open portion.

19. The mixing device of claim 11, wherein at least one of the first nonconcentric mass or the second nonconcentric mass is weighted nonconcentrically, creating an imbalanced mass when rotated.

* * * * *